US011846404B1

(12) United States Patent
Deng et al.

(10) Patent No.: US 11,846,404 B1
(45) Date of Patent: Dec. 19, 2023

(54) OUTDOOR SECURITY MULTI-HEAD LAMP USING HYBRID LIGHTING SOURCES

(71) Applicant: Dong Guan Technomate Metal Ware Manufactory Ltd, Guang Dong (CN)

(72) Inventors: Qiaohui Deng, Guang Dong (CN); Fanggen Zhu, Guang Dong (CN)

( * ) Notice: Subject to any disclaimer, the term of this patent is extended or adjusted under 35 U.S.C. 154(b) by 0 days.

(21) Appl. No.: 18/087,798

(22) Filed: Dec. 22, 2022

(51) Int. Cl.

| | |
|---|---|
| ***F21V 19/02*** | (2006.01) |
| ***F21V 23/04*** | (2006.01) |
| ***F21S 8/00*** | (2006.01) |
| *F21Y 115/10* | (2016.01) |

(52) U.S. Cl.
CPC ..... *F21V 19/02* (2013.01); *F21S 8/036* (2013.01); *F21V 23/0442* (2013.01); *F21Y 2115/10* (2016.08)

(58) Field of Classification Search
CPC ..... F21V 23/0442; F21V 19/02; F21S 8/036
See application file for complete search history.

(56) References Cited

U.S. PATENT DOCUMENTS

2019/0212003 A1* 7/2019 Lazear ..... F21V 21/30

FOREIGN PATENT DOCUMENTS

WO WO-2022177601 A1 * 8/2022 ..... F21V 23/02

* cited by examiner

*Primary Examiner* — Anabel Ton

(57) ABSTRACT

The invention relates to the technical field of lighting lamps, in particular to an outdoor security multi-head lamp using hybrid lighting sources, comprising: a lamp holder, a main control board, a power module and a lamp head assembly. The lamp head assembly is provided with a movable mount and multiple lamp head structures and at least two lighting sources are installed on the lamp head assembly. Hybrid lighting sources are used to realize diversified functions and control modes, such that the lamp can be used for atmosphere creation, building decoration, light modeling, light beautification of courtyard landscapes and other environments.

8 Claims, 3 Drawing Sheets

OUTDOOR SECURITY MULTI-HEAD LAMP USING HYBRID LIGHTING SOURCES

BACKGROUND OF THE INVENTION

The invention relates to the technical field of lighting lamps, in particular to an outdoor security multi-head lamp using hybrid lighting sources.

Outdoor lighting lamps are commonly used both in courtyard and garden landscapes. Most existing outdoor lighting lamps are only used for environmental lighting, and cannot function as security sensor lamps or for atmosphere creation, thus being not suitable for colored atmospheres and light modeling of buildings, which leads to a high idle rate of the outdoor lighting lamps. Users have to purchase atmospheric lamps to create special atmospheres, which leaves the outdoor lamps only with a lighting function unused and increases the cost for purchasing the atmospheric lamps, thus causing great inconvenience to users; moreover, lamps with diversified functions are more difficult to install and control, which brings trouble to users.

Thus, it is necessary to provide an outdoor security multi-head lamp using hybrid lighting sources to better solve the above-mentioned problems.

BRIEF SUMMARY OF THE INVENTION

To solve the above-mentioned problems, the invention provides an outdoor security multi-head lamp using hybrid lighting sources, which is simple in structure and reasonable in design, and can realize diversified functions and control modes by using hybrid lighting sources, thus being not only suitable for lighting, but also suitable for atmosphere creation, building decoration, light modeling, light beautification of courtyard landscapes, and other environments.

The technical solution adopted by the invention is as follows:

An outdoor security multi-head lamp using hybrid lighting sources comprises a lamp holder, a main control board, a power module and a lamp head assembly, wherein:

The main control board is installed in the lamp holder;

The power module is installed in the lamp holder, and is connected to the main control board and the lamp head assembly;

The lamp head assembly is provided with a movable mount and multiple lamp head structures, wherein the movable mount is movably installed on the lamp holder, the multiple lamp head structures are movably installed on the movable mount, and at least two lighting sources are installed on the multiple lamp head structures and/or the movable mount, and are connected to the main control board.

Further, the outdoor security multi-head lamp using hybrid lighting sources further comprises a sensor module, wherein the sensor module is installed on the lamp holder and is connected to the main control board.

Further, the movable mount comprises a connecting plate and multiple movable arms;

The connecting plate is movably connected to the lamp holder;

Each of the multiple movable arms has an end movably connected to the connecting plate and an end movably connected to one lamp head structure.

Further, the lighting sources comprise an LED lighting source and an RGBW lighting source.

Further, the RGBW lighting source is covered with a lens structure.

Further, the outdoor security multi-head lamp using hybrid lighting sources further comprises a mounting plate, wherein the mounting plate is connected to the lamp holder and is connected to an external component.

Further, the outdoor security multi-head lamp using hybrid lighting sources further comprises an AC connecting port, wherein the AC connecting port is disposed on the mounting plate and is connected to the power module.

Further, the main control board is provided with a lighting control module, which is connected to the lighting sources and is used for adjusting a lighting mode of the lighting sources.

Further, the main control board is provided with an intelligent control module and an on-line control module;

The intelligent control module is connected to an external component to realize intelligent control;

The on-line control module is used for linkage and synchronous control of lamps.

Further, the sensor module is a sensor head, and the sensor head is provided with a signal receiver;

The main control board is provided with a sensing control module, which is connected to the signal receiver and is used for adjusting a sensing mode of the sensor module.

The invention has the following beneficial effects:

The outdoor security multi-head lamp using hybrid lighting sources comprises a lamp holder, a main control board, a power module and a lamp head assembly, wherein the power module is installed in the lamp holder, and is connected to the main control board and the lamp head assembly; the lamp head assembly is provided with a movable mount movably installed on the lamp holder and multiple lamp head structures movably installed on the movable mount, and at least two lighting sources are installed on the multiple lamp head structures and/or the movable mount, and are connected to the main control board; the lamp is simple and reasonable in structure; and at least two lighting sources are used to realize diversified functions and control modes, such that the lamp not only can be used for lighting, but also can be used for atmosphere creation, building decoration, light modeling, light beautification of courtyard landscapes and other environments, thus being wide in application range and convenient to use.

Figure 1:
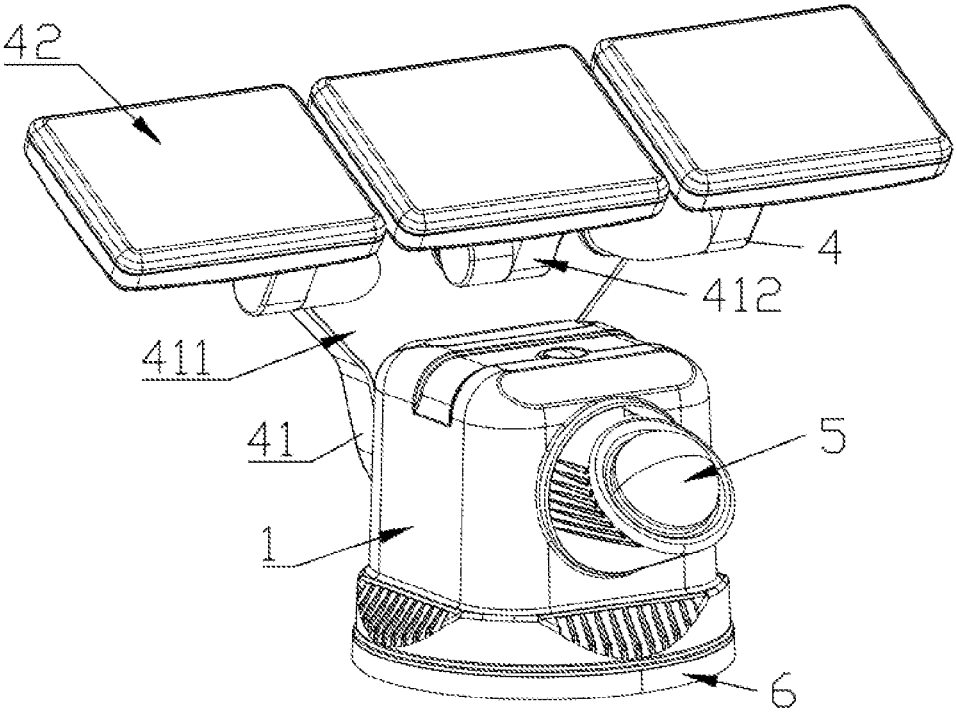
FIG. 1 is a structural view of some embodiments of the application.

Reference signs: 1, lamp holder; 2, main control board; 3, power module; 4, lamp head assembly; 41, movable support; 411, connecting plate; 412, movable arm; 42, lamp head structure; 43, lighting source; 44, lens structure; 5, sensing assembly; 6, mounting plate; 7, AC connecting port.

DETAILED DESCRIPTION OF THE INVENTION

The technical solution of the invention will be clearly and completely described below in conjunction with the accompanying drawings. Obviously, the embodiments in the following description are merely illustrative ones, and are not all possible ones of the invention. All other embodiments obtained by those ordinarily skilled in the art according to the following ones without creative labor should fall within the protection scope of the invention.

In the description of the invention, it should be noted that terms such as "upper", "lower", "left", "right", "vertical", "horizontal", "inner", "outer", "front" and "back", are used to indicate directional or positional relations based on the accompanying drawings merely for the purpose of facilitating and simplifying the description of the application, and do not indicate or imply that devices or elements referred to must be in a specific direction, or be configured and operated in a specific direction, so they should not be construed as limitations of the application.

In the description of the invention, it should be noted that, unless otherwise specifically stated and defined, the terms "install", "link" and "connect" should be broadly understood. For example, they may refer to fixed connection, detachable connection, or integral connection; or, mechanical connection, direct connection, or indirect connection through an intermediate medium. Those ordinarily skilled in the art can understand the specific meanings of these terms in the invention as the case may be.

As shown in FIG. 1-FIG. 4, this embodiment provides an outdoor security multi-head lamp using hybrid lighting sources, which comprises a lamp holder 1, a main control board 2, a power module 3 and a lamp head assembly 4;

The main control board 2 is installed in the lamp holder 1;

The power module 3 is installed in the lamp holder 1, and is connected to the main control board 2 and the lamp head assembly 4;

The lamp head assembly 4 is provided with a movable mount 41 and multiple lamp head structures 42, wherein the movable mount 41 is movably installed on the lamp holder 1, the multiple lamp head structures 42 are movably installed on the movable mount 41, and at least two lighting sources 43 are installed on the multiple lamp head structures 42 and/or the movable mount 41, and are connected to the main control board 2.

The lamp in this embodiment is simple and reasonable; and at least two lighting sources 43 are used to realize diversified functions and control modes, such that the lamp not only can be used for lighting, but also can be used for atmosphere creation, building decoration, light modeling, light beautification of courtyard landscapes and other environments, thus being wide in application range and convenient to use.

Figure 4:
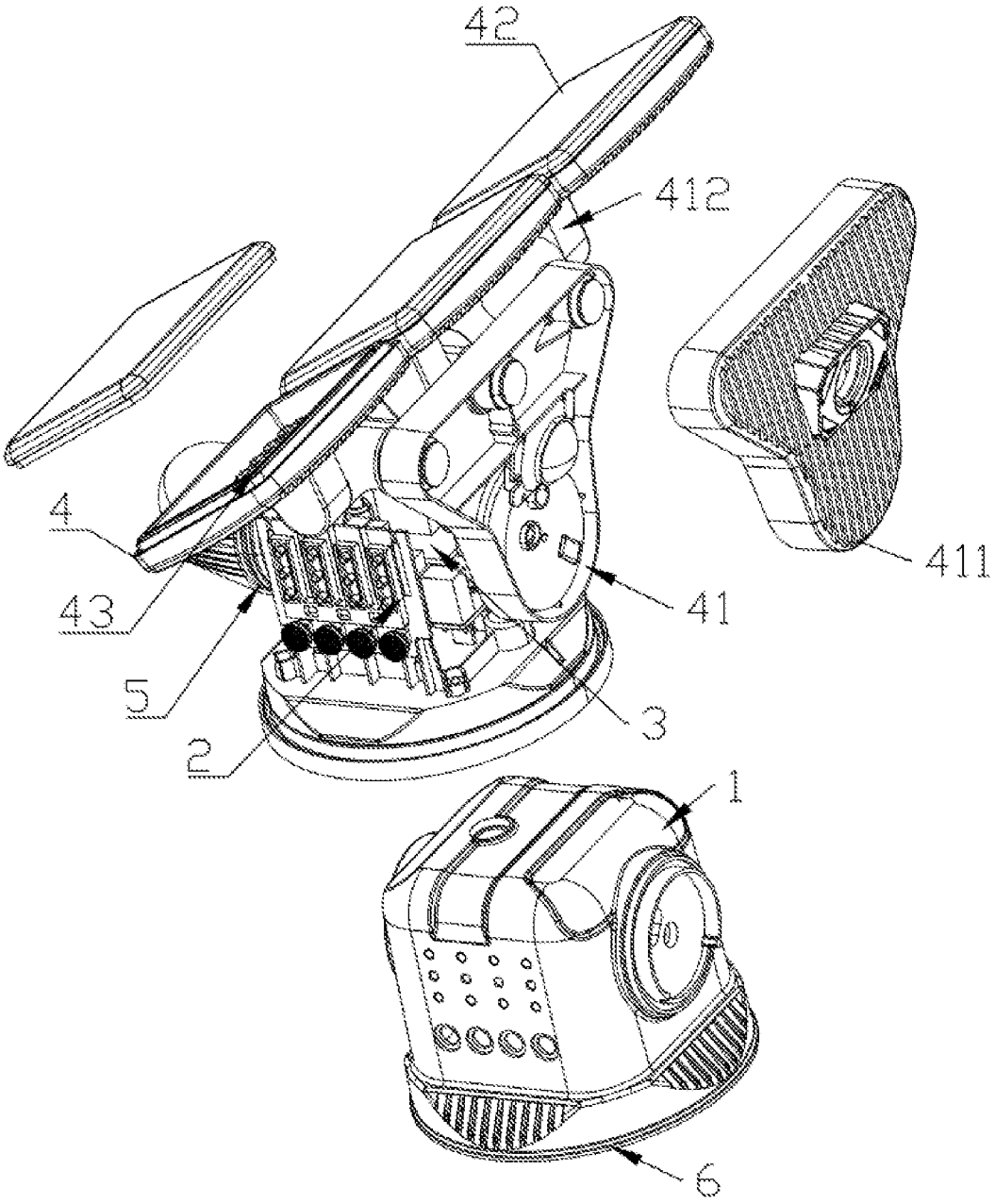
FIG. 4 is an exploded structural view of some embodiments of the application.

Specifically, in this embodiment, the lighting sources 43 may be single-color lighting sources and multi-color lighting sources to realize the effects of lighting and light color changing, such that light in more colors can be realized, and the atmospheres can be adjusted. During specific adjustment, the single-color lighting sources and the multi-color lighting sources on the lamp head structures 42 and the movable mount 41 can be combined or separated to be used. Specifically, as shown in FIG. 4, one lighting source 43 is installed on the lamp head structures 42 and the other lighting source 43 is installed on the movable mount 41, such that the two lighting sources 43 can be used together. This is merely a specific example, and is not used to limit the specific installation position of the lighting sources 43.

In some embodiments, the outdoor security multi-head lamp further comprises a sensor module 5, wherein the sensor module 5 is installed on the lamp holder 1 and is connected to the main control board 2.

Specifically, the sensor module 5 is a sensor head which is provided with a signal receiver;

The main control board 2 is provided with a sensing control module, which is connected to the signal receiver and is used for adjusting the sensing mode of the sensor module.

In this embodiment, the sensor module 5 is arranged to realize a sensing function, such that the functions of the lamp are further enriched. During specific use, the sensor head may be rotatably installed on the lamp holder 1, such that the sensing angle can be adjusted flexibly; the sensing mode such as the sensing situation (such as the sensing distance) and environmental monitoring (such as environmental temperature and brightness) can be adjusted through the sensing control module, and an environment or object can be recognized based on sensing information to control the lamp; and the lamp is simple in structure, and convenient to adjust and use.

In some embodiments, the movable mount 41 comprises a connecting plate 411 and multiple movable arms 412;

The connecting plate 411 is movably connected to the lamp holder;

Each of the multiple movable arms 412 has an end movably connected to the connecting plate 411 and an end movably connected to one lamp head structure 42.

Figure 2:
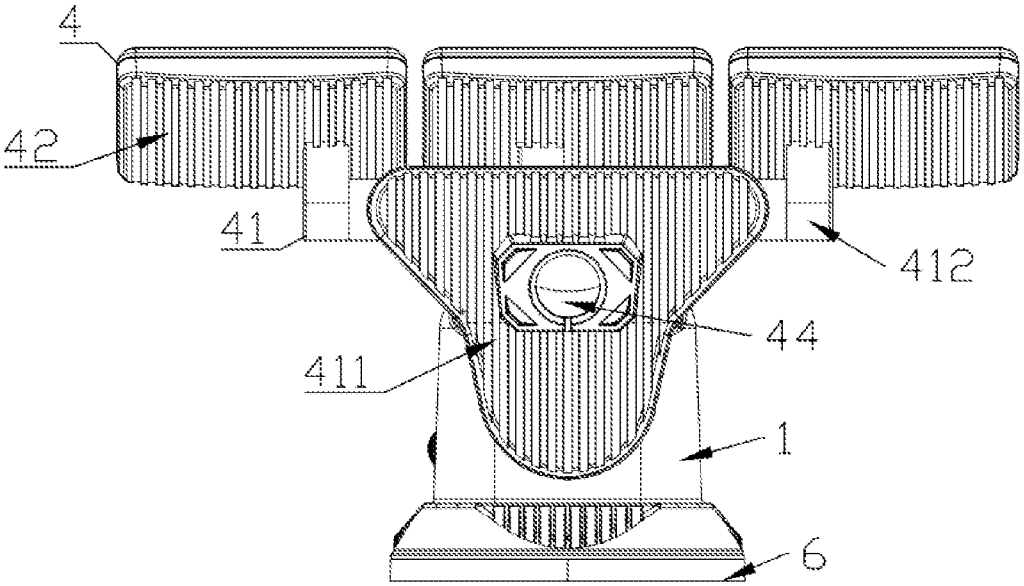
FIG. 2 is a structural view of FIG. 1 from another perspective.
Figure 3:
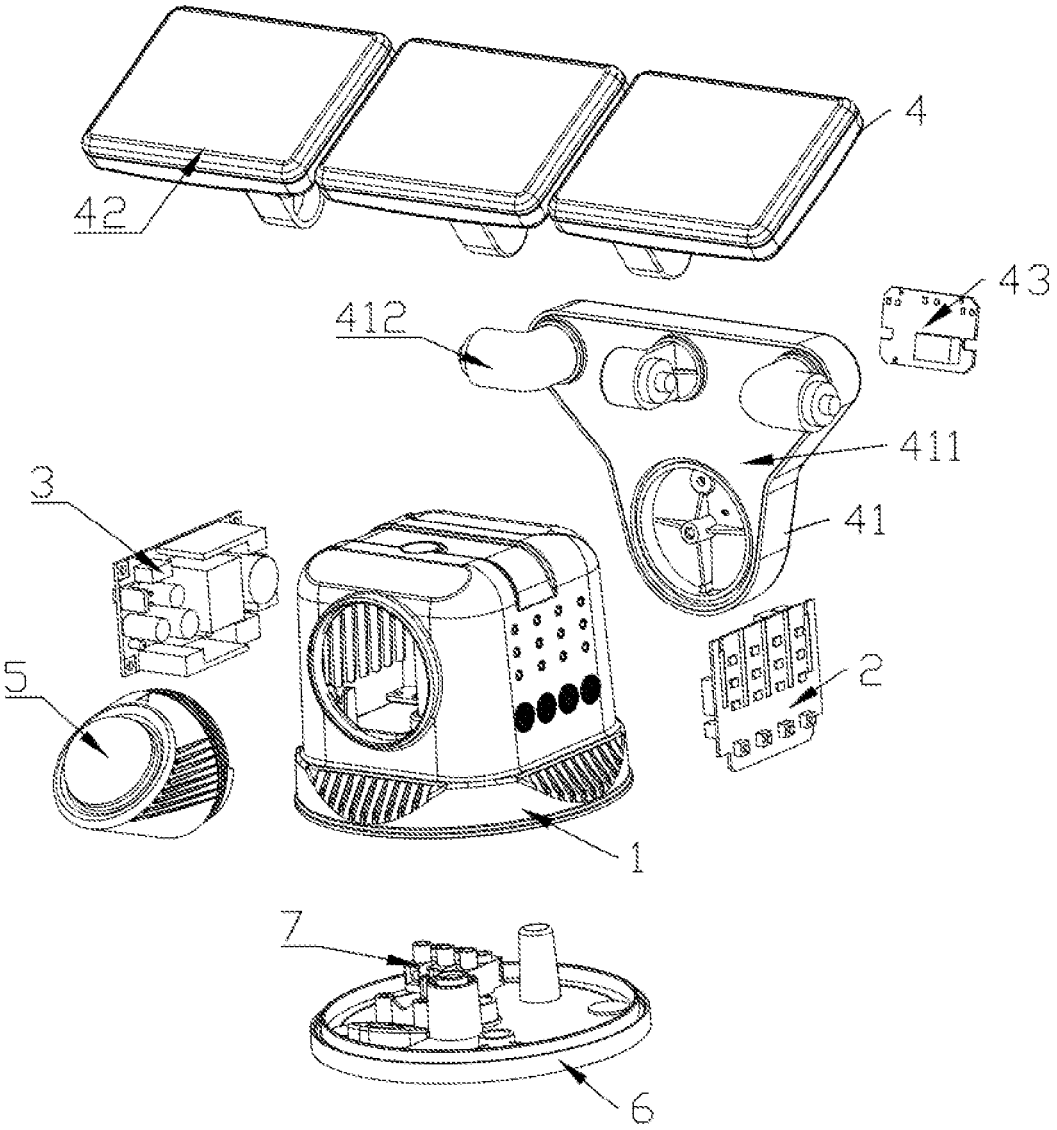
FIG. 3 is an exploded structural view of some embodiments of the application.

In this embodiment, the structure of the movable mount 41 is specifically illustrated; through the connecting plate 411 and the movable arms 412, the movable mount 41 can be rotated and adjusted flexibly, and the multiple lamp head structures 42 can be connected, rotated and adjusted easily through the multiple movable arms 412; and one or more of the lighting sources 43 can be installed on the connecting plate 411 to realize multi-angle lighting adjustment, and specifically, as shown in FIG. 2, one lighting source 43 is installed on a back side of the connecting plate 411. The lamp in this embodiment is simple in structure, and convenient to adjust and use.

In some specific examples, the lighting sources 43 comprise an LED lighting source and an RGBW lighting source.

In this embodiment, the lighting sources 43 comprise the LED lighting source and the RGBW lighting source by way of example, such that hybrid lighting sources can be used to change and adjust multiple lighting modes of the lamp, and multi-functional lighting of the lamp is adjusted.

Based on the above embodiment, the RGBW lighting source is covered with a lens structure 44.

In this embodiment, through the lens structure 44, light emitted by the RGBW lighting source can be focused and adjusted; and the structure is simple, and the practicability is high.

In some embodiments, the outdoor security multi-head lamp further comprises a mounting plate 6, wherein the mounting plate 6 is connected to the lamp holder 1 and is connected to an external component.

Specifically, the outdoor security multi-head lamp further comprises an AC connecting port 7, wherein the AC connecting port 7 is disposed on the mounting plate 6 and is connected to the power module 3.

In this embodiment, the lamp can be installed to be used through the mounting plate 6, and can be connected to a mains supply through the AC connecting port 7 to supply power.

In some embodiments, the main control board 2 is provided with a lighting control module, which is connected to the lighting sources 43 and is used for adjusting the lighting mode of the lighting sources 43.

In this embodiment, the lighting time, brightness and lighting mode of the lighting sources 43 can be adjusted through the lighting control module during use, such that the lighting mode can be easily controlled.

In some embodiments, the main control board 2 is provided with an intelligent control module and an on-line control module;

The intelligent control module is connected to an external component to realize intelligent control;

The on-line control module is used for linkage and synchronous control of lamps.

In this embodiment, the intelligent control module is connected to an external component to realize intelligent control, for example, the atmospheric lighting mode and the modeling light mode can be realized through a remote control, Bluetooth of a mobile phone, an APP and the like; or, the intelligent control module may be provided with a signal communication terminal such as Bluetooth or WIFI to realize intelligent control of courtyard lamps; on-line control module is mainly used as a linkage module between multiple courtyard lamps, such that interconnected control of the lamps can be realized, multiple lamps can be linked and controlled through one lamp, or the functions of multiple lamps can be controlled synchronous; and the design is reasonable, and the practicability is high.

The above embodiments are merely several illustrative ones of the invention, and are specifically described in detail, but they should not be construed as limitations of the patent scope of the invention. It should be pointed out that various transformations and improvements can be made by those ordinarily skilled in the art without departing from the concept of the invention, and all these transformations and improvements fall within the protection scope of the invention. Thus, the protection scope of the patent of invention should be subject to the appended claims.

What is claimed is:

1. An outdoor security multi-head lamp using hybrid lighting sources, comprising a lamp holder, a main control board, a power module and a lamp head assembly, wherein:

the main control board is installed in the lamp holder;

the power module is installed in the lamp holder, and is connected to the main control board and the lamp head assembly;

the lamp head assembly is provided with a movable mount and multiple lamp head structures, wherein the movable mount is movably installed on the lamp holder, the multiple lamp head structures are movably installed on the movable mount, and at least two lighting sources are installed on the multiple lamp head structures and/or the movable mount, and are connected to the main control board;

the outdoor security multi-head lamp using hybrid lighting sources further comprises a mounting plate, wherein the mounting plate is connected to the lamp holder and is connected to an external component;

the outdoor security multi-head lamp using hybrid lighting sources further comprises an AC connecting port, wherein the AC connecting port is disposed on the mounting plate and is connected to the power module.

2. The outdoor security multi-head lamp using hybrid lighting sources according to claim 1, further comprising a sensor module, wherein the sensor module is installed on the lamp holder and is connected to the main control board.

3. The outdoor security multi-head lamp using hybrid lighting sources according to claim 1, wherein the movable mount comprises a connecting plate and multiple movable arms;

the connecting plate is movably connected to the lamp holder;

each of the multiple movable arms has an end movably connected to the connecting plate and an end movably connected to one said lamp head structure.

4. The outdoor security multi-head lamp using hybrid lighting sources according to claim 1, wherein the lighting sources comprise an LED lighting source and an RGBW lighting source.

5. The outdoor security multi-head lamp using hybrid lighting sources according to claim 4, wherein the RGBW lighting source is covered with a lens structure.

6. The outdoor security multi-head lamp using hybrid lighting sources according to claim 1, wherein the main control board is provided with a lighting control module, which is connected to the lighting sources and is used for adjusting a lighting mode of the lighting sources.

7. The outdoor security multi-head lamp using hybrid lighting sources according to claim 1, wherein the main control board is provided with an intelligent control module and an on-line control module;

the intelligent control module is connected to an external component to realize intelligent control;

the on-line control module is used for linkage and synchronous control of lamps.

8. The outdoor security multi-head lamp using hybrid lighting sources according to claim 2, wherein:

the sensor module is a sensor head, and the sensor head is provided with a signal receiver;

the main control board is provided with a sensing control module, which is connected to the signal receiver and is used for adjusting a sensing mode of the sensor module.

* * * * *